US009811033B2

(12) United States Patent
Miki

(10) Patent No.: US 9,811,033 B2
(45) Date of Patent: Nov. 7, 2017

(54) FIXING DEVICE AND IMAGE FORMING APPARATUS THEREWITH

(71) Applicant: KYOCERA Document Solutions Inc., Osaka (JP)

(72) Inventor: Masafumi Miki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/288,838

(22) Filed: Oct. 7, 2016

(65) Prior Publication Data

US 2017/0168439 A1 Jun. 15, 2017

(30) Foreign Application Priority Data

Dec. 9, 2015 (JP) ..... 2015-240046

(51) Int. Cl.
*G03G 15/20* (2006.01)

(52) U.S. Cl.
CPC ..... *G03G 15/2085* (2013.01)

(58) Field of Classification Search
CPC combination set(s) only.
See application file for complete search history.

(56) References Cited

U.S. PATENT DOCUMENTS

2011/0222881 A1* 9/2011 Yamada ..... G03G 15/2032 399/45
2015/0117920 A1* 4/2015 Moteki ..... G03G 15/2028 399/323

FOREIGN PATENT DOCUMENTS

JP 2012-128222 A 7/2012
JP 2013-57791 A 3/2013

* cited by examiner

*Primary Examiner* — Clayton E Laballe
*Assistant Examiner* — Jas Sanghera
(74) *Attorney, Agent, or Firm* — Stein IP, LLC

(57) ABSTRACT

A fixing device includes a pressure mechanism and a pressure adjustment mechanism. The pressure mechanism includes a pressing member holding one of the pressure member and the heating member and a biasing member biasing the pressing member in a direction toward or away from the other of the pressure member and the heating member. The pressure adjustment mechanism includes an eccentric cam. The pressure adjustment mechanism uses one of small-diameter and large-diameter parts formed in the outer peripheral surface of the eccentric cam to allow the pressure mechanism to give the nip pressure, and uses the other of them to allow the pressure mechanism to release the nip pressure. When the large-diameter part is used to allow the pressure mechanism to give or release the nip pressure, the eccentric cam constantly receives reaction force urging it to rotate in a direction toward the small-diameter part.

6 Claims, 5 Drawing Sheets

FIXING DEVICE AND IMAGE FORMING APPARATUS THEREWITH

INCORPORATION BY REFERENCE

This application is based upon and claims the benefit of priority from the corresponding Japanese Patent Application No. 2015-240046 filed on Dec. 9, 2015, the entire contents of which are incorporated herein by reference.

BACKGROUND

The present disclosure relates to a fixing device mounted in an image forming apparatus employing an electro-photographic method, such as a copier, a printer, a facsimile, and a multifunction peripheral (MFP) equipped with functions of these apparatuses, and in particular, the present disclosure relates to a fixing device capable of releasing nip pressure between a heating member and a pressure member, and an image forming apparatus including such a fixing device.

Conventionally, an image forming apparatus includes a fixing device for fixing a toner image transferred from an image carrier onto a recording material such as a sheet. Known examples of fixing methods employed in fixing devices include a roller fixing method using a heating roller and a pressure roller that rotate in contact with each other, and a belt fixing method using an endless fixing belt as a heating member. For example, in a fixing device employing the roller fixing method, a toner image carried on a sheet is fixed on the sheet by heating and pressing the toner image at a nip portion between a fixing roller and a pressure roller pressed against each other.

In such a fixing device, a sheet jam is sometimes caused where a sheet under conveyance is stuck in a nip portion between the heating roller and the pressure roller. Thus, it is necessary to provide a configuration for releasing nip pressure between a heating member and a pressure member to clear a sheet jam.

For example, there is known a fixing device that includes a pressure mechanism giving nip pressure to a nip portion between a pressure member and a heating member, and a pressure releasing mechanism varying the nip pressure given to the nip portion, the pressure releasing mechanism being an eccentric cam contacting a roller of a spring compression member included in the pressure mechanism, and having a variable distance from its rotation center to its outer peripheral surface.

There is also known a fixing device that includes pressed state switching means switching between a first state where a fixing roller (a heating member) and a pressure member are relatively pressed against each other and a second state where the pressed state is released, the pressed state switching means being an eccentric cam.

SUMMARY

According to one aspect of the present disclosure, a fixing device includes a heating member, a pressure member contacting the heating member to form a nip portion, a pressure mechanism giving nip pressure to the nip portion, and a pressure adjustment mechanism varying the nip pressure given to the nip portion. In the fixing device, a recording medium carrying a toner image passes through the nip portion to have the toner image heated and pressed to be fixed on the recording medium. The pressure mechanism includes a pressing member and a biasing member. The pressing member holds one of the pressure member and the heating member, and the pressing member is supported to be swingable in directions toward and away from the other of the pressure member and the heating member. The biasing member has an end thereof in contact with the pressing member to bias the pressing member in a direction toward or away from the other of the pressure member and the heating member. The pressure adjustment mechanism includes an eccentric cam in which a distance from a rotation center of the eccentric cam to an outer peripheral surface of the eccentric cam varies in a circumferential direction, the pressure adjustment mechanism using one of a small-diameter part and a large-diameter part formed in the outer peripheral surface of the eccentric cam to allow the pressure mechanism to give the nip pressure to the nip portion, the pressure adjustment mechanism using the other of the small-diameter part and the large-diameter part to allow the pressure mechanism to release the nip pressure. When the large-diameter part of the eccentric cam is used to allow the pressure mechanism to give the nip pressure to the nip portion or release the nip pressure, the eccentric cam constantly receives reaction force urging the eccentric cam to rotate in a direction toward the small-diameter part.

Further features and specific advantages of the present disclosure will become apparent from the following descriptions of preferred embodiments.

DETAILED DESCRIPTION

Figure 1:
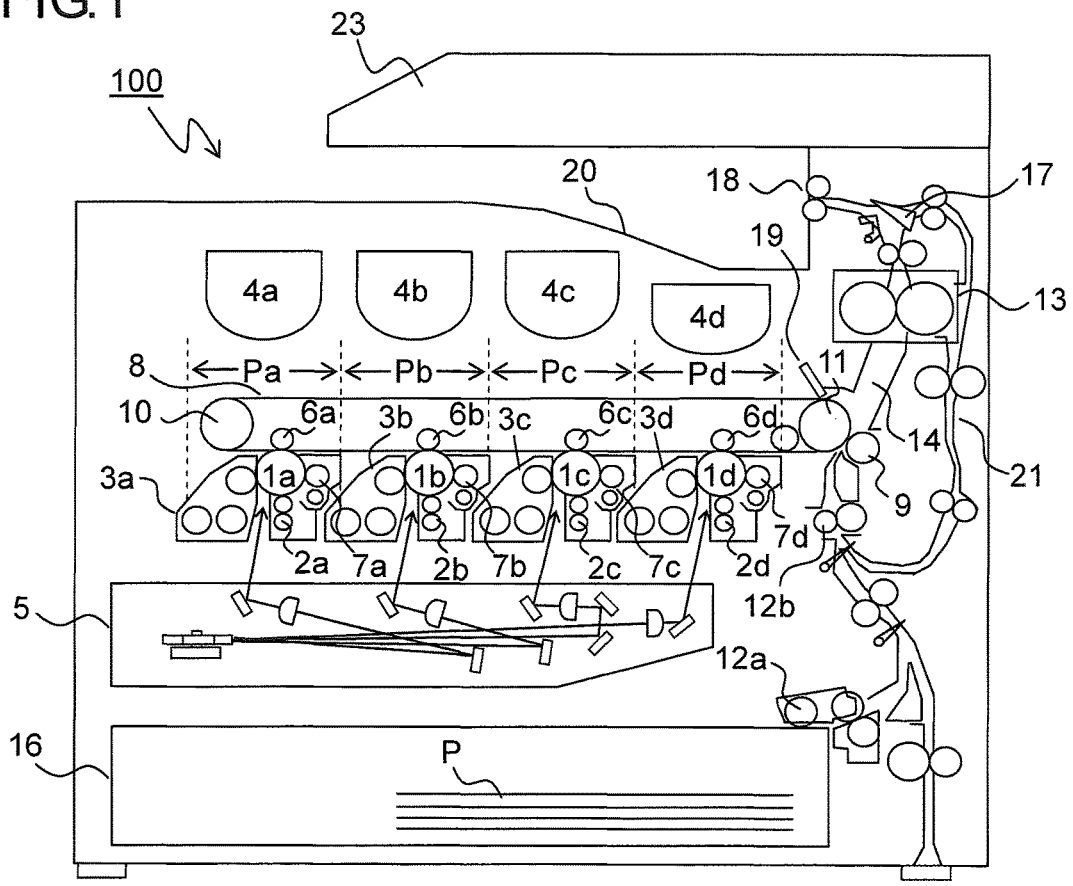
FIG. 1 is a schematic sectional view illustrating an overall configuration of an image forming apparatus 100 including a fixing device 13 according to an embodiment of the present disclosure.

Hereinafter, embodiments of the present disclosure will be described with reference to the accompanying drawings. FIG. 1 is a sectional view illustrating a schematic configuration of an image forming apparatus 100 including a fixing device 13 according to an embodiment of the present disclosure.

Inside a main body of the image forming apparatus 100, four image forming portions Pa, Pb, Pc, and Pd are arranged in order from a left side in FIG. 1. The image forming portions Pa, Pb, Pc, and Pd correspond to images of four different colors (magenta, cyan, yellow, and black), and sequentially form magenta, cyan, yellow, and black images through steps of charging, exposing, developing, and transferring.

These image forming portions Pa, Pb, Pc, and Pd include photosensitive drums 1*a*, 1*b*, 1*c*, and 1*d*, respectively, that carry visible images (toner images) of corresponding colors, and further, an intermediate transfer belt 8 configured to rotate in a counterclockwise direction in FIG. 1 is arranged adjacent to the image forming portions Pa to Pd.

A sheet P, onto which a toner image is to be transferred, is stored in a sheet cassette 16 in a lower part of the main body of the image forming apparatus 100, and the sheet P is conveyed via a sheet feeding roller 12*a* and a registration roller pair 12*b* to a secondary transfer roller 9.

Next, the image forming portions Pa to Pd will be described. Provided around and below the photosensitive drums 1*a* to 1*d*, which are disposed to be rotatable, are the following components: charging devices 2*a*, 2*b*, 2*c*, and 2*d* that charge the photosensitive drums 1*a*, 1*b*, 1*c*, and 1*d*, respectively; an exposure unit 5 that exposes the photosensitive drums 1*a* to 1*d* to light based on image data; developing devices 3*a*, 3*b*, 3*c*, and 3*d* that develop, using toner, electrostatic latent images formed on the photosensitive drums 1*a*, 1 *b*, 1*c*, and 1*d*, respectively; and cleaning devices 7*a*, 7*b*, 7*c*, and 7*d* that recover and remove developer (toner) remaining on the photosensitive drums 1*a*, 1*b*, 1*c*, and 1*d*, respectively, after the toner images on the photosensitive drums 1*a* to 1*d* are transferred.

In a copying operation, an image reading portion 23 reads image data of a document and converts the image data into an image signal. The charging devices 2*a*, 2*b*, 2*c*, and 2*d* uniformly charge surfaces of the photosensitive drums 1*a*, 1 *b*, 1*c*, and 1*d*, respectively. Then, based on the image data, the exposure unit 5 irradiates the photosensitive drums 1*a* to 1*d* with light to form electrostatic latent images on the photosensitive drums 1*a* to 1*d* according to the image data. The developing devices 3*a* to 3*d* include developing rollers (developer carriers) each facing a corresponding one of the photosensitive drums 1*a* to 1*d*, and the developing devices 3*a* to 3*d* are each filled with a predetermined amount of two-component developer containing toner of a corresponding one of the respective colors, namely, magenta, cyan, yellow, and black.

Primary transfer rollers 6*a*, 6*b*, 6*c*, and 6*d* give a predetermined transfer voltage across the primary transfer rollers 6*a*, 6*b*, 6*c*, and 6*d* and the photosensitive drums 1*a*, 1 *b*, 1*c*, and 1*d*, respectively. Thereby, the magenta, cyan, yellow, and black toner images formed on the photosensitive drums 1*a* to 1 *d* are primarily transferred onto the intermediate transfer belt 8. Thereafter, residual toner remaining on the surface of each of the photosensitive drums 1*a*, 1*b*, 1*c*, and 1*d* is removed by the cleaning devices 7*a*, 7*b*, 7*c*, and 7*d*, respectively.

The intermediate transfer belt 8 is wound around and between a driven roller 10 and a driving roller 11. The intermediate transfer belt 8 starts to rotate in the counterclockwise direction in conjunction with rotation of the driving roller 11 caused by a belt driving motor. Then, the sheet P is conveyed from the registration roller pair 12*b* at a predetermined timing to a nip portion (a secondary transfer nip portion) between the intermediate transfer belt 8 and the secondary transfer roller 9 contacting the intermediate transfer belt 8. At the nip portion, a full-color image is secondarily transferred onto the sheet P. The sheet P onto which the toner image has been transferred is conveyed through a sheet conveyance path 14 to the fixing device 13.

At the fixing device 13, the sheet P is heated and pressed while passing through a nip portion (a fixing nip portion) between a fixing roller 131 and a pressure roller 132 (for both, see FIG. 2), and thereby a predetermined full-color image is formed. The sheet P on which the full-color image has been formed is discharged onto a discharge tray 20 by a discharge roller pair 18 as it is (or after being directed by a branching portion 17 into a reverse conveyance path 21 and having an image formed on its opposite side).

Figure 2:
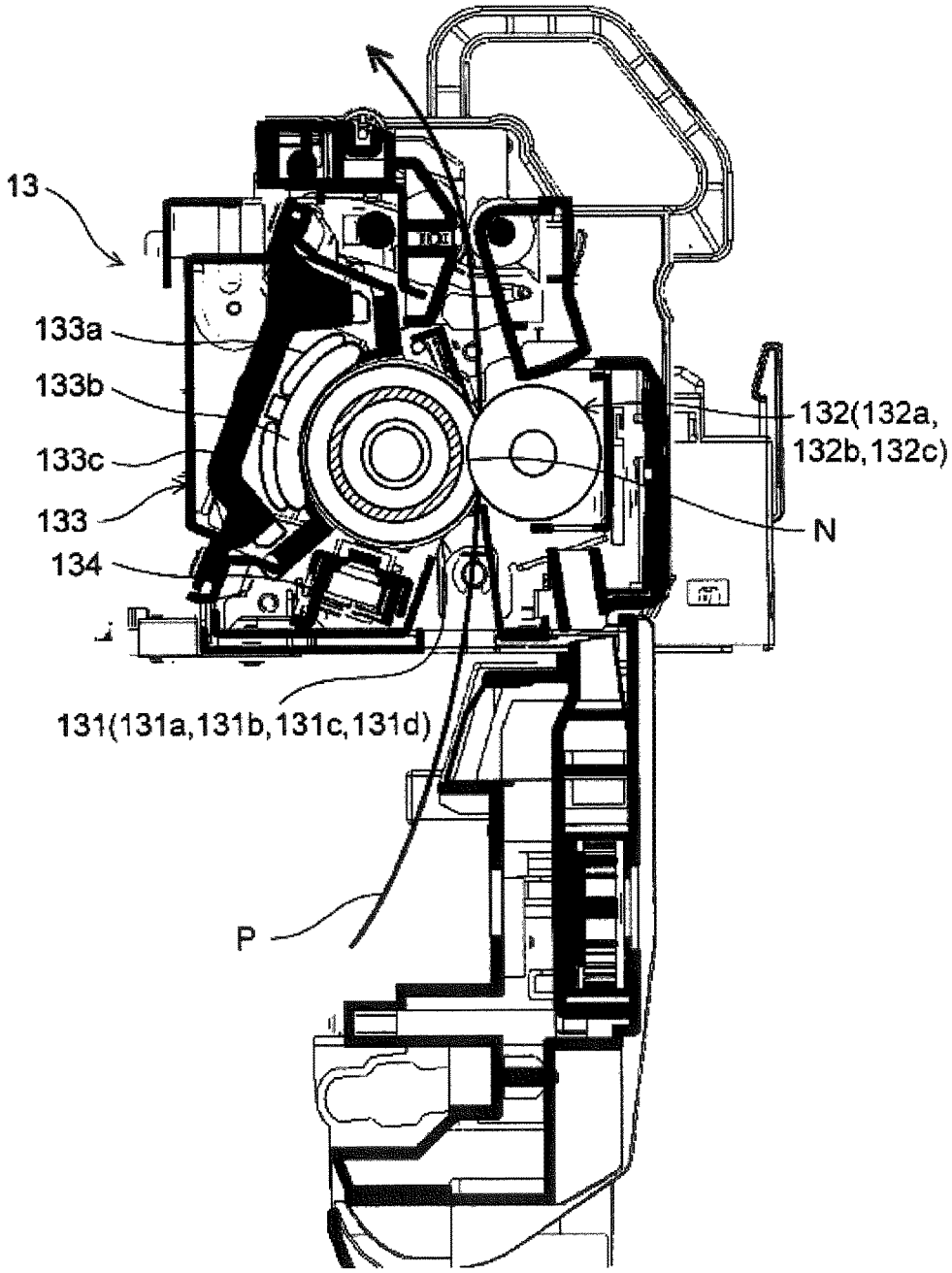
FIG. 2 is an enlarged sectional view around the fixing device 13 illustrated in FIG. 1.

FIG. 2 is side sectional view around the fixing device 13 illustrated in FIG. 1. The fixing device 13 employs a fixing method using an electromagnetic-induction-heating heat source, and includes the fixing roller 131 as a heating member, the pressure roller 132 as a pressure member, an induction heating portion 133 facing an outer periphery of the fixing roller 131, and temperature sensors 134 each including a thermistor, for example, and detecting temperature of a surface of the fixing roller 131. The induction heating portion 133 and the temperature sensors 134 are fixed to the main body of the image forming apparatus 100, and the fixing roller 131 and the pressure roller 132 are rotatably held on a housing of the fixing device 13.

The fixing roller 131 includes a stainless steel cylinder as a base 131*a* and an elastic layer 131*d* made of a silicone rubber sponge, for example. The elastic layer 131*d* helps improve elasticity and releasing performance of a nip portion N formed by pressing the fixing roller 131 against the pressure roller 132. Between the base 131*a* and the elastic layer 131*d*, there is formed a heat insulating layer 131*b* and an induction heat generation layer 131*c* in order from the base 131*a* side.

The pressure roller 132 includes an aluminum core as a base 132*a*, an elastic layer 132*b* formed of a silicone rubber on the base 132*a*, and a release layer 132*c* formed of a fluorine resin as a tube covering a surface of the elastic layer 132*b*. The elastic layer 132*b* gives elasticity to the nip portion N. The release layer 132*c* helps improve releasing performance in fixing an unfixed toner image by fusing at the nip portion N.

The pressure roller 132 is driven to rotate by a drive source such as a motor (unillustrated), and is further pressed by a later-described pressure mechanism 50 against the fixing roller 131 in a direction toward a center of the fixing roller 131. Thereby, the pressure roller 132 is pressed against the fixing roller 131, and when the pressure roller 132 rotates, the fixing roller 131 also rotates following the rotation of the pressure roller 132 such that surfaces of the fixing roller 131 and the pressure roller 132 facing at the nip portion N move in a same direction.

The temperature sensors 134 are disposed on a surface of the fixing roller 131, one disposed in a sheet-passing region in a middle part of the surface in an axial direction (a direction of the width of the fixing roller 131), another and the other disposed facing each other at end portions of the surface in the axial direction, the end portions being non-sheet-passing regions when a small-size sheet passes or an A4-size sheet passes with a short side thereof ahead, and the temperature sensors 134 detect temperatures of the regions. Based on the temperatures detected by the temperature sensors 134, power supply to the induction heating portion 133 is controlled to maintain temperature of the surface of the fixing roller 131 at a predetermined temperature.

The induction heating portion 133 includes an excitation coil 133*a*, a bobbin 133*b*, and a core 133*c*, and heats the fixing roller 131 by electromagnetic induction. The induction heating portion 133 extends in an axial direction of the fixing roller 131, and is disposed facing the fixing roller 131 to surround part of the outer periphery of the fixing roller 131.

The excitation coil 133*a*, which is made of a copper wire, is wound on the bobbin 133*b* to be arranged in a spiral shape across a part of the outer periphery of the fixing roller 131 such that the excitation coil 133*a* circles around a middle part of the core 133*c* in an axial direction. The excitation coil 133*a* is connected to an unillustrated power supply, and generates a magnetic flux using a high-frequency current supplied from the power supply. The magnetic flux from the induction heating portion 133 is guided in a direction parallel to the sheet on which FIG. 2 is drawn, and penetrates through the induction heat generation layer 131*c* of the fixing roller 131. An eddy current is generated around the magnetic flux in the induction heat generation layer 131*c*, and when the eddy current flows, Joule heat is generated due to electrical resistance in the induction heat generation layer 131*c*, and in this manner, the induction heat generation layer 131*c* generates heat.

Based on temperatures detected by the temperature sensors 134, power of the power supply is controlled such that the fixing roller 131 is heated to a predetermined temperature by the induction heating portion 133. When the fixing roller 131 is heated to the predetermined temperature, the sheet P nipped at the nip portion N is heated and is also pressed by the pressure roller 132. Thereby, the toner in a powder state on the paper sheet P is fused to be fixed.

Figure 3:
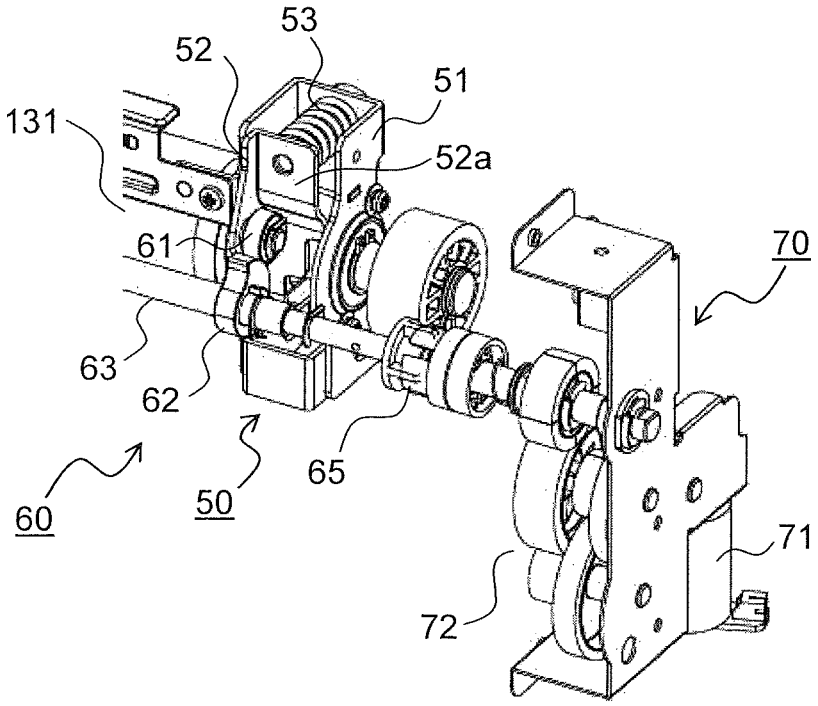
FIG. 3 is a perspective view illustrating a pressure mechanism 50 and a pressure releasing mechanism 60 in the fixing device 13 of the present embodiment, as viewed from a side opposite to a pressure roller 132, with a fixing roller 131 pressed against the pressure roller 132.
Figure 4:
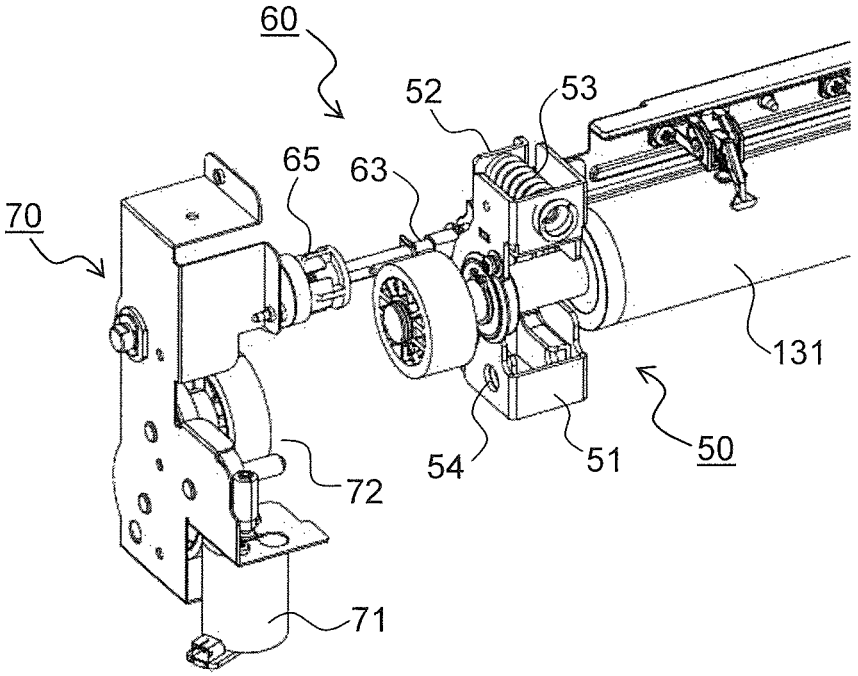
FIG. 4 is a perspective view illustrating the pressure mechanism 50 and the pressure releasing mechanism 60 in the fixing device 13 of the present embodiment, as viewed from a side of the pressure roller 132, with the fixing roller 131 pressed against the pressure roller 132.
Figure 5:
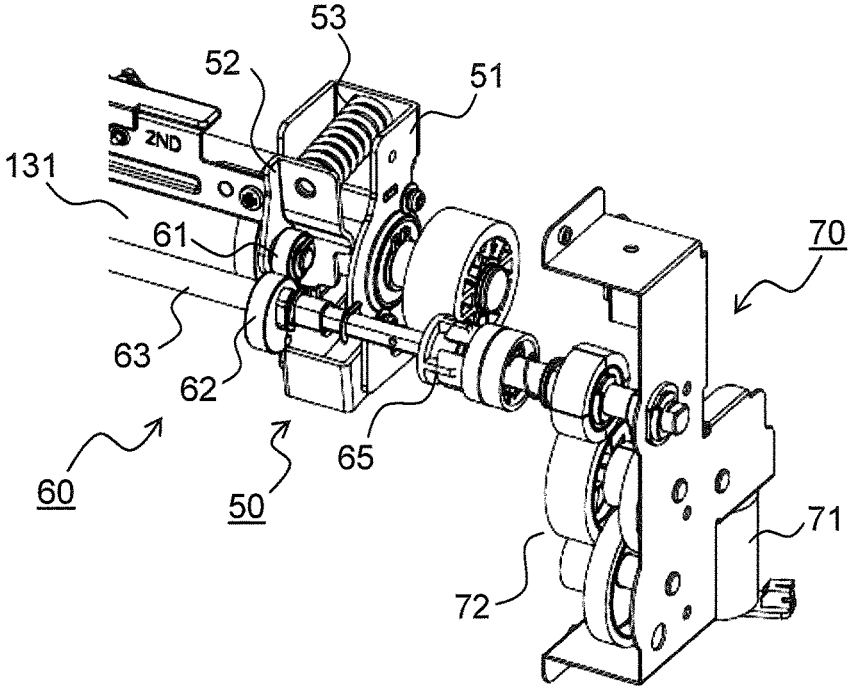
FIG. 5 is a perspective view illustrating the pressure mechanism 50 and the pressure releasing mechanism 60 in the fixing device 13 of the present embodiment, as viewed from the side opposite to the pressure roller 132, after pressing of the fixing roller 131 against the pressure roller 132 is released.
Figure 6:
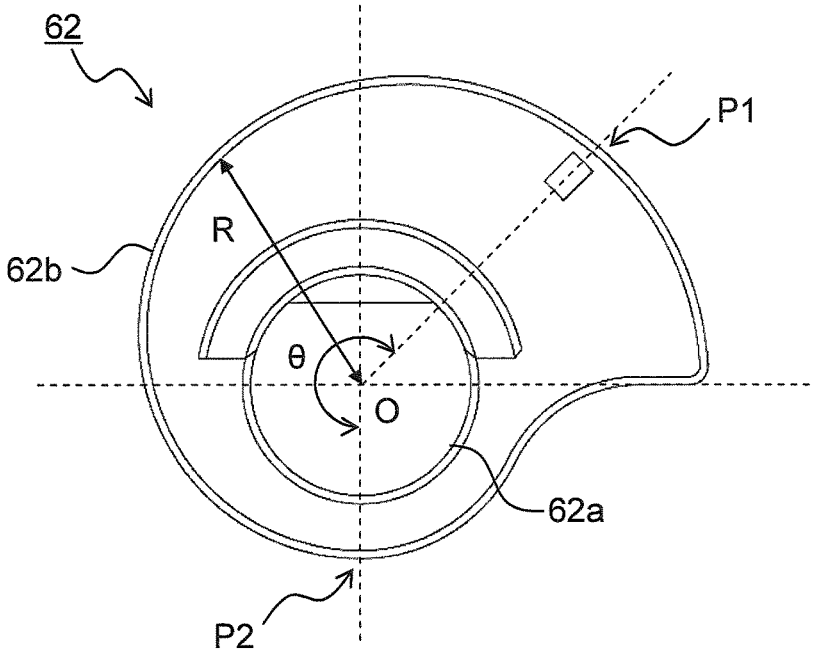
FIG. 6 is a front view of an eccentric cam 62 included in the pressure releasing mechanism 60.

FIGS. 3 to 5 are perspective views illustrating the pressure mechanism 50 and a pressure releasing mechanism 60, which are included in the fixing device 13. FIG. 6 is a front view of an eccentric cam 62, which is one of a pair of eccentric cams 62 included in the pressure releasing mechanism 60. The fixing device 13 includes, as described above, the fixing roller 131, the pressure roller 132, the induction heating portion 133, and the temperature sensors 134, and the fixing device 13 further includes the pressure mechanism 50 and the pressure releasing mechanism 60. FIGS. 3 and 4 illustrate a state where the fixing roller 131 is pressed against the pressure roller 132, and FIG. 5 illustrates a state where the fixing roller 131 is not pressed against the pressure roller 132. For convenience of description, the pressure roller 132 is not illustrated in these figures.

The pressure mechanism 50 presses the fixing roller 131 against the pressure roller 132 to generate nip pressure at the nip portion N (see FIG. 2), and the pressure mechanism 50 includes a roller pressing member 51, a spring compression member 52, and a pressing spring 53. The pressure mechanism is composed of a pair of pressure mechanisms 50, which are disposed one at the side of each end of the fixing roller 131. Note that FIGS. 3 to 5 illustrate just one pressure mechanism 50 disposed at the side of one end of the fixing roller 131.

The roller pressing member 51 is made of a sheet of metal in a predetermined shape. The pressure roller 132 is rotatably supported on a substantially middle part of the roller pressing member 51. In a lower part of the roller pressing member 51, there is formed a bearing hole 54, in which a support shaft (not shown) provided on the housing of the fixing device 13 is fitted, and the roller pressing member 51 is held by the housing of the fixing device 13 to be swingable about the support shaft as a fulcrum. One end of the pressing spring 53 is in contact with an upper part of the roller pressing member 51.

The spring compression member 52 is made of a sheet of metal in a predetermined shape. At a right side part of the spring compression member 52, there is formed a contact portion 52*a*, which has a shape of a flat plate. The spring compression member 52 is held on the housing of the fixing device 13 to be swingable about the same fulcrum (the support shaft) as the roller pressing member 51. The other end of the pressing spring 53 is in contact with an upper part of the spring compression member 52. A cylindrical roller 61 is rotatably attached to the spring compression member 52.

Two ends of the pressing spring 53 are respectively in contact with the roller pressing member 51 to compress the spring compression member 52 from its natural length. With this configuration, the roller pressing member 51 and the spring compression member 52 are biased by the pressing spring 53 in directions away from each other, and as a result, the fixing roller 131 is pressed against the pressure roller 132 to give a predetermined pressure to the nip portion N.

The pressure releasing mechanism 60 varies biasing force that the pressing spring 53 generates, and the pressure releasing mechanism 60 includes the pair of eccentric cams 62 disposed one on the side of each end of the fixing roller 131 and a connection shaft 63. Note that FIG. 3 and FIG. 5 illustrate just one eccentric cam 62 disposed on the side of one end of the fixing roller 131.

At one end of the connection shaft 63, a drive coupling 65 is disposed to be connected with a gear train 72 of a later-described drive portion 70. The pair of eccentric cams 62 are fixed to the connection shaft 63 to be aligned with each other in phase. Thereby, rotation drive force from the drive portion 70 is transmitted simultaneously to the eccentric cam 62 on the right and to the eccentric cam 62 on the left, such that the biasing force generated by the pressing spring 53 is varied simultaneously on both sides of the fixing roller 131.

Each eccentric cam 62 is rotatable together with the connection shaft 63, and contacts a roller 61 attached to the spring compression member 52. As illustrated in FIG. 6, the eccentric cam 62 has a through hole 62*a* through which the connection shaft 63 is inserted, and the eccentric cam 62 has a comma-like shape such that a distance from a rotation center O to an outer peripheral surface 62*b* of the eccentric cam 62 is variable on a periphery of the eccentric cam 62. The outer peripheral surface 62*b* of the eccentric cam 62 includes a pressing position P1 (a large-diameter part), at which the eccentric cam 62 presses the fixing roller 131 against the pressure roller 132, and a releasing position P2 (a small-diameter part), at which a radius R from the rotation center O to the outer peripheral surface 62*b* is smaller than at the pressing position P1. An angle θ from the pressing position P1 to the releasing position P2 is about 225°.

The distance (a radius) R from the rotation center O to the outer peripheral surface 62*b* of the eccentric cam 62 is not constant in the vicinity of the pressing position P1, but the radius R varies, continuously increasing in a region (of the angle θ) from the releasing position P2 to the pressing position P1. As a result, the eccentric cam 62 constantly receives from the roller 61 reaction force (resistance force) in a rotation direction (a direction toward the releasing position P2).

The drive portion 70 is disposed at the side of one end of the fixing roller 131, and includes a motor 71 and the gear train 72. The motor 71 is a forwardly and reversely rotatable DC motor, for example. When the motor 71 is driven to rotate by a motor drive circuit (not shown), the eccentric cam 62 is caused to rotate forwardly or reversely via the gear train 72, the drive coupling 65, and the connection shaft 63.

Next, a description will be given of operations of the pressure mechanism 50 and the pressure releasing mechanism 60 in the fixing device 13 of the present embodiment. In a normal printing state, as illustrated in FIG. 3 and FIG. 4, the eccentric cam 62 is in contact with the roller 61 at the pressing position P1 (see FIG. 6), and the pressing spring 53 is compressed by a predetermined amount by the roller pressing member 51 and the spring compression member 52. In this state, the roller pressing member 51 receives a predetermined biasing force from the pressing spring 53, and the fixing roller 131 is pressed against the pressure roller 132 with a predetermined nip pressure.

In a case where a sheet is jammed in the nip portion N, the motor 71 is driven to rotate in a predetermined direction by a predetermined amount to rotate the eccentric cam 62 by 225° from the state illustrated in FIG. 3 such that the releasing position P2 of the eccentric cam 62 comes into contact with the roller 61. As a result, the spring compression member 52 swings in a direction away from the roller pressing member 51, and this reduces the biasing force applied to the roller pressing member 51 by the pressing spring 53, as compared with the biasing force in the state illustrated in FIG. 4. Thereby, a nipping state between the fixing roller 131 and the pressure roller 132 is released, making it possible to clear the sheet jam.

After the sheet jam is cleared, the eccentric cam 62 is rotated in a reverse direction by 225° such that the pressing position P1 of the eccentric cam 62 returns into contact with the roller 61 as illustrated in FIG. 3. Thereby, the normal printing state is recovered in which the fixing roller 131 is pressed against the pressure roller 132 with the predetermined nip pressure.

In the present embodiment, the radius R of the eccentric cam 62 varies continuously increasing from the releasing position P2 to the pressing position P1, and thus, when the eccentric cam 62 is in contact with the roller 61 at the pressing position P1, the eccentric cam 62 constantly receives, from the roller 61, the reaction force urging the eccentric cam 62 in a direction from the pressing position P1 toward the releasing position P2. This helps prevent an abrupt increase of the reaction force in the rotation direction of the eccentric cam 62 from occurring in switching a contact position at which the eccentric cam is in contact with the roller 61 from the pressing position P1 to the releasing position P2. This allows smooth rotation of the eccentric cam 62 and helps reduce noise caused due to backlash (play) in meshing parts of the drive coupling 65 and the gear train 72.

In the present embodiment, the eccentric cam 62 is rotated by 225°, as the rotation angle θ, to switch the contact position of the eccentric cam 62 between the pressing position P1 and the releasing position P2, but the rotation angle θ may be appropriately set as necessary. Here, by setting the rotation angle θ to 180° or larger, it is possible to reduce an amount of variation (a rate of variation per unit angle) in radius R in switching the contact position between the pressing position P1 and the releasing position P2, and to further moderate load variation in releasing the nip pressure.

In the present embodiment, the radius R of the eccentric cam 62 continuously increases in the region from the releasing position P2 to the pressing position P1, but instead, the radius R may continuously increase from the releasing position P2 to a position past the pressing position P1. In this case, it is possible to make the reaction force in the rotation direction act on the eccentric cam 62 more securely when the pressing position P1 of the eccentric cam 62 is in contact with the roller 61.

Figure 7:
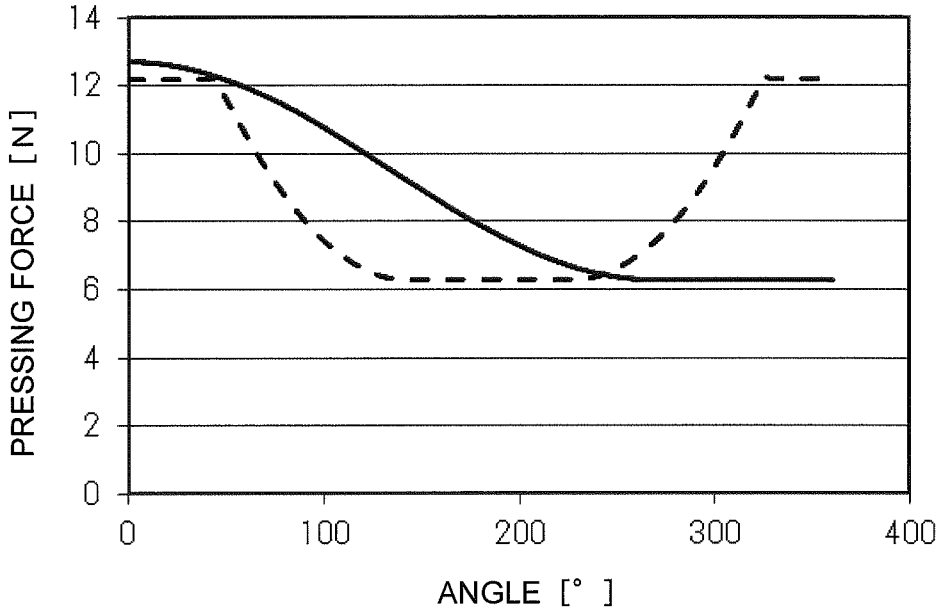
FIG. 7 is a graph illustrating load variation observed when a contact position of the eccentric cam 62 with respect to a roller 61 was switched from a pressing position P1 to a releasing position P2.

FIG. 7 is a graph illustrating load variation observed when the contact position of the eccentric cam 62 with respect to the roller 61 was switched from the pressing position P1 to the releasing position P2. FIG. 7 was obtained by measuring variation in nip pressure between the fixing roller 131 and the pressure roller 132, between a case in which was used an eccentric cam 62 shaped as illustrated in FIG. 6 with a radius R continuously increasing from the releasing position P2 to the pressing position P1 and a case in which was used a conventional eccentric cam 62 with a radius R constant in the vicinity of the pressing position P1, with the nip pressure during normal printing being 12 N and the nip pressure after pressure release being 6 N.

As is clear from FIG. 7, in the case of using the eccentric cam 62 with the radius R continuously increasing from the releasing position P2 to the pressing position P1 (indicated by a solid line in FIG. 7), when the contact position of the eccentric cam 62 with respect to the roller 61 was switched from the pressing position P1 to the releasing position P2, pressing force decreased linearly, and no abrupt load variation (load reduction) was observed.

In contrast, in the case of using the eccentric cam 62 with the radius R constant in the vicinity of the pressing position P1 (indicated by a broken line in FIG. 7), the pressing force abruptly decreased immediately after the eccentric cam 62 in contact with the roller 61 at the pressing position P1 was rotated. In response to the abrupt reduction of the pressing force, reaction force in the rotation direction of the eccentric cam 62 increased abruptly to invite larger noise in meshing parts of the drive coupling 65 and the gear train 72.

From these results, it was confirmed that the use of the eccentric cam 62 with the radius R continuously increasing from the releasing position P2 to the pressing position P1 effectively reduced noise generated in the course of releasing the nip pressure between the fixing roller 131 and the pressure roller 132.

It should be understood that the present disclosure is not limited to the above embodiments, and various modifications are possible within the scope of the present disclosure. For example, in the above-described embodiments, an example has been dealt with to which the present disclosure is applied to a roller-fixing type fixing device 13, but this is not meant as a limitation. The present disclosure is applicable to a belt-fixing fixing device using an endless fixing belt as a heating member, a fixing device employing a method where a heating member is built by using a fixedly supported heating body and a heat-resistant film slidable in tight contact with the heating body, and the heating body and a pressure roller are pressed against each other with the heat-resistant film interposed therebetween. Further, as for the heat source, the induction heating portion 133 may be replaced with a heater, and the pressure mechanism 50 and the pressure releasing mechanism 60 may be provided on the pressure roller 132.

In the above-described embodiments, the eccentric cam 62 is in contact with the spring compression member 52 on a side opposite to the pressing spring 53, but the eccentric cam 62 may be in contact with the spring compression member 52 on a reverse side (on the pressing spring 53 side). In that case, the eccentric cam 62 compresses the pressing spring 53 to release the nip pressure between the fixing roller 131 and the pressure roller 132 when the large-diameter part (the position of P1 in FIG. 6) comes into contact with the roller 61. Nip pressure is given between the fixing roller 131 and the pressure roller 132 by biasing force from the pressing spring 53 when the small-diameter part (the position of P2 in FIG. 6) comes into contact with the spring compression member 52.

And, with the radius R continuously increasing in the range from the small-diameter part to the large-diameter part as in the above-described embodiments, the eccentric cam 62 constantly receives reaction force that urges the eccentric cam 62 to rotate in the direction toward the small-diameter part when the large-diameter part of the eccentric cam 62 is in contact with the spring compression member 52. This makes it possible to effectively reduce noise generated in the course of giving nip pressure between the fixing roller 131 and the pressure roller 132.

The present disclosure is applicable to a fixing device for use in an image forming apparatus employing the electrophotographic method, such as a copier, a printer, a facsimile machine, or a multifunction peripheral having functions of these. By the use of the present disclosure, it is possible to provide a fixing device capable of reducing noise generated in the course of releasing a state where a heating member and a pressure member are pressed against each other, and an image forming apparatus including the same.

What is claimed is:

1. A fixing device comprising:

a heating member;

a pressure member contacting the heating member to form a nip portion;

a pressure mechanism comprising a pressing member holding one of the pressure member and the heating member and supported to be swingable in directions toward and away from another of the pressure member and the heating member and a biasing member one end of which contacts the pressing member to bias the pressing member in a direction toward or away from the other of the pressure member and the heating member, the pressure mechanism giving nip pressure to the nip portion; and a pressure adjustment mechanism comprising an eccentric cam in which a distance from a rotation center of the eccentric cam to an outer peripheral surface of the eccentric cam varies in a circumferential direction of the eccentric cam, the pressure adjustment mechanism varying the nip pressure given to the nip portion, wherein the pressure adjustment mechanism uses one of a small-diameter part of the outer peripheral surface of the eccentric cam and a large-diameter part of the outer peripheral surface of the eccentric cam, the distance from the rotation center of the eccentric cam to the outer peripheral surface of the eccentric cam being larger at the large-diameter part than at the small-diameter part, to allow the pressure mechanism to give the nip pressure, and uses another of the small-diameter part and the large-diameter part to allow the pressure mechanism to release the nip pressure, when the large-diameter part of the eccentric cam is used by the pressure adjustment mechanism to allow the pressure mechanism to give or release the nip pressure, the eccentric cam constantly receives reaction force urging the eccentric cam to rotate in a direction toward the small-diameter part, a recording medium carrying a toner image passes through the nip portion to have the toner image heated and pressed to be fixed on the recording medium, and the eccentric cam has a curved shape in which the distance from the rotation center of the eccentric cam to the outer peripheral surface of the eccentric cam continuously increases in a whole region from the small-diameter part to the large-diameter part.

2. The fixing device according to claim 1, wherein in the eccentric cam, a pressing position for allowing the pressure mechanism to give the nip pressure is located at the large-diameter part, and a releasing position for allowing the pressure mechanism to release the nip pressure is located at the small-diameter part.

3. The fixing device according to claim 1, wherein in the eccentric cam, a pressing position for allowing the pressure mechanism to give the nip pressure is located in a vicinity of the large-diameter part, between the small-diameter part and the large diameter part, and a releasing position for allowing the pressure mechanism to release the nip pressure is located at the small-diameter part.

4. The fixing device according to claim 1, wherein a rotation angle by which the eccentric cam is forwardly or reversely rotated to switch between the small-diameter part and the large-diameter part is 180° or larger.

5. The fixing device according to claim 1, wherein the pressure mechanism comprises a spring compression member with which another end of the biasing member is in contact, and that is supported to be swingable in directions toward and away from the pressing member, and the outer peripheral surface of the eccentric cam is in contact with a roller included in the spring compression member.

6. An image forming apparatus comprising the fixing device according to claim 1.

* * * * *